United States Patent [19]

Schumacher et al.

[11] Patent Number: 5,018,444

[45] Date of Patent: May 28, 1991

[54] INK APPLYING SYSTEM FOR A PRINTING APPARATUS

[75] Inventors: Thomas H. Schumacher, Downers Grove; Ronald L. Nelson, Hanover Park, both of Ill.

[73] Assignee: WPC Machinery Corporation, Downers Grove, Ill.

[21] Appl. No.: 486,015

[22] Filed: Feb. 28, 1990

[51] Int. Cl.[5] ..... B41F 31/00

[52] U.S. Cl. ..... 101/366; 101/365; 101/349

[58] Field of Search ..... 101/348, 349, 350, 365, 101/366, 207-210, 363, DIG. 32, 148

[56] References Cited

U.S. PATENT DOCUMENTS

| | | | |
|---|---|---|---|
| 956,083 | 4/1910 | Harland | 101/365 |
| 2,225,749 | 12/1940 | Marchev | 101/132.5 |
| 2,229,583 | 1/1941 | Morris | 101/132.5 |
| 2,674,941 | 4/1954 | Hopwood et al. | 101/212 |
| 3,662,682 | 5/1972 | Marozzi | 101/350 |
| 3,976,004 | 8/1976 | England, III et al. | 101/366 |
| 4,027,766 | 6/1977 | Sargentini et al. | 101/336 |
| 4,270,483 | 6/1981 | Butler et al. | 101/217 |
| 4,281,597 | 8/1981 | Dressler | 101/366 |
| 4,570,539 | 2/1986 | Rottstedt | 101/365 |
| 4,577,558 | 3/1986 | Fischer | 101/365 |
| 4,838,164 | 6/1989 | Miyoshi et al. | 101/366 |

FOREIGN PATENT DOCUMENTS

| | | | |
|---|---|---|---|
| 2145973 | 4/1985 | United Kingdom | 101/350 |

*Primary Examiner*—Edgar S. Burr
*Assistant Examiner*—Ren Yan
*Attorney, Agent, or Firm*—Welsh & Katz, Ltd.

[57] ABSTRACT

An ink supply system that is operable to precisely provide ink to a transfer roll by means of positively pumping ink to an absorbent medium adjacent to a ductor wheel at a programmably controlled rate and to bring the ductor wheel into and out of contact with a transfer cylinder also at a programmably controlled rate.

22 Claims, 2 Drawing Sheets

INK APPLYING SYSTEM FOR A PRINTING APPARATUS

The present invention generally relates to a system for feeding ink to a printing apparatus, and more particularly relates to a system for feeding ink to a printing apparatus of the type which applies ink to a print medium that utilizes an inking cylinder which rotates at high speed to apply successive impressions to the print medium.

It has always been a problem of quality control in the web printing industry to feed the correct amount of ink to a printing unit so that the impression that is printed has desired quality. This is determined by many characteristics, depending upon the type of printing that is being performed, the medium on which the printing is being done, the type of ink that is being applied, and the like. For example, letterpress and lithographic printing require relatively low viscosity inks, whereas flexographic printing utilize inks which have a high viscosity and typically dry very quickly.

The application of ink to the printing units has typically involved the metering of literally drops of ink to a roll or cylinder of a train of such rolls that result in an impression being printed on the print medium. Since one drop of ink may be sufficient to print several hundred, if not several thousand impressions, and since the amount of ink used is a function of the surface area of the actual printed indicia, a pressman must adjust the flow of ink to accommodate the job that is being done. Another important consideration known to those in the art, is that small amounts of ink may be used in certain portions of the width of the web, and larger amounts of ink may be used in other areas, primarily because more surface area of text or graphics may be printed in certain portions than others. In most prior art metering systems, the ink has been gravity fed from a common manifold to a number of tubes or conduits, the ends of which are positioned along the width of the web to feed ink to the applicable roll. The pressman must therefore calibrate the metering of ink to accommodate these requirements.

However, even when properly calibrated, problems are often experienced. One common problem is that when a new drop is applied to the applicable inking roll, the first impressions may be too dark because too much ink is applied to the medium, and as the ink is depleted the impressions will gradually begin to lighten until the next drop is applied. Another problem is that the inking roll is usually rotating at a high rate of speed, so that when the drop of ink is applied to it, at least a portion of the ink may be thrown out, which creates clean up problems for the press. Also, gravity fed ink metering systems often become clogged, with the problem being aggravated by certain types of inks, which may either dry prematurely, or because of their low viscosity.

The foregoing considerations are involved in most types of printing units, and for that reason the present invention is applicable to many types of printing units. However, the present invention is particularly useful in applying ink to a numbering unit or imprinting unit, which may be positioned to print different text or numbers on different parts of the web being printed. For example, an advertising brochure may be printed showing the sale items for a certain time frame, and it may be distributed over a wide geographical area. An imprinter may be used to print the name and address of a local establishment, and the brochures having that establishment's name and address may comprise a very small portion of the total run of such brochures, with other establishments' names and addresses being printed on the remainder of the brochures. Similarly, numbers may be printed on sweepstakes type materials or the like.

Such imprinters and numbering units may have a ductor wheel which applies ink to a transfer cylinder by being moved into and out of contact with the transfer cylinder on a periodic basis during a printing operation. While the use of a ductor wheel may reduce the problem of throwing out ink that is dropped onto it, it is not completely eliminated, because when the ductor wheel is brought into contact with the transfer cylinder, some degree of throw-out may occur.

It is an object of the present invention to substantially eliminate the foregoing problems that are associated with ink supplying mechanisms.

It is an object of the present invention to provide an improved ink supplying system for a printing unit, which system supplies ink in a forced manner rather than by gravity, and which can be precisely calibrated to provide ink at a controlled rate to certain portions of the width of the web, and to apply the ink to the transfer cylinder in a controlled manner whereby too much ink is not provided at one time so as to result in too dark of an impression.

It is yet another object of the present invention to provide such an improved ink supplying system which accomplishes the foregoing objects by utilizing a processing means based programmable controller which is programmable to control the pumping of a precise quantity of ink to a ductor wheel, and which controls the movement of the ductor wheel into and out of contact with the transfer cylinder at precisely controlled and programmable intervals.

Yet another object of the present invention lies in the provision of utilizing an absorbent medium adjacent the ductor wheel which controls the flow of ink that is applied to the ductor wheel in a manner which substantially eliminates the problem of throw-out of the ink.

These and other objects will become apparent upon reading the following detailed description of the present invention, while referring to the attached drawings, in which:

FIG. 1 is a side view, partially in section, of portions of the apparatus of the present invention, particularly illustrating the ductor wheel and associated structure, and the ink pumping means; and, FIG. 2 is a cross sectional view of a portion of the apparatus illustrated in FIG. 1, and is taken generally along the line 2—2 in FIG. 1; and, FIG. 3 is a schematic block diagram of the programmable controller and its interconnection with the apparatus illustrated in FIGS. 1 and 2.

DETAILED DESCRIPTION

Broadly stated, the present invention is directed to an ink supply system that is operable to precisely provide ink to a transfer roll by means of positively pumping ink to an absorbent medium adjacent to a ductor wheel at a programmably controlled rate and to bring the ductor wheel into and out of contact with a transfer cylinder also at a programmable controlled rate. The design and operation of the system substantially eliminates the problems that have often occurred in prior art systems, including the problem of the ink being thrown out when it is dropped onto a cylinder rotating at high speed, the problem of relying on gravity to control the rate of flow of ink to such rolls, and the problem of accurately adjusting the metering of ink that is supplied by the system.

While the system disclosed herein is particularly adapted for use in numbering or imprinting printing units, where a relatively small width of the web is printed, it has a much wider scope of application, in that it could be made wider, or a number of narrow units could be combined to apply ink to a wider area along the width of the web. In fact, an entire width of a web could be effectively covered by combining a large number of such supply systems, which could be controlled by a single programmable controller, with the segments covered by individual systems being programmed to have the correct amount of ink supplied to print the desired text or graphic material. To this end, it is contemplated that systems that would be adjacent one another along the width of the web would be radially displaced so that the end of one ductor wheel would cover an inking area that would actually abut the area covered by the next ductor wheel. Since the diameter of the transfer cylinder is relatively large compared to the diameters of the ductor wheels, such radial offsetting is a practical manner in which such a number of systems could be implemented. It should also be appreciated that the system is applicable for many types of printing, and could be employed to supply inks that have the characteristics necessary to perform letterpress printing and lithographic printing, among other types.

Figure 1:
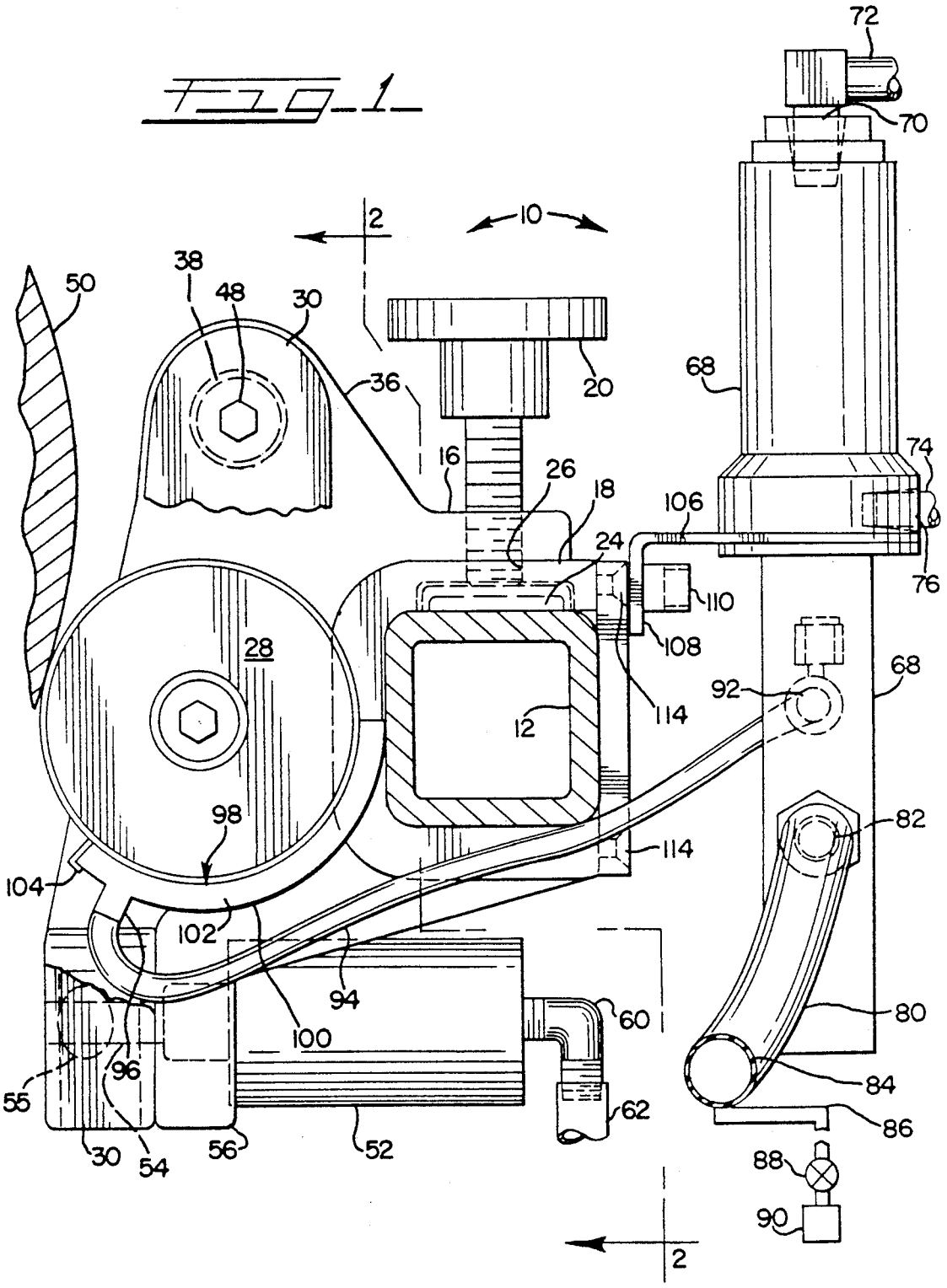
Figure 2:
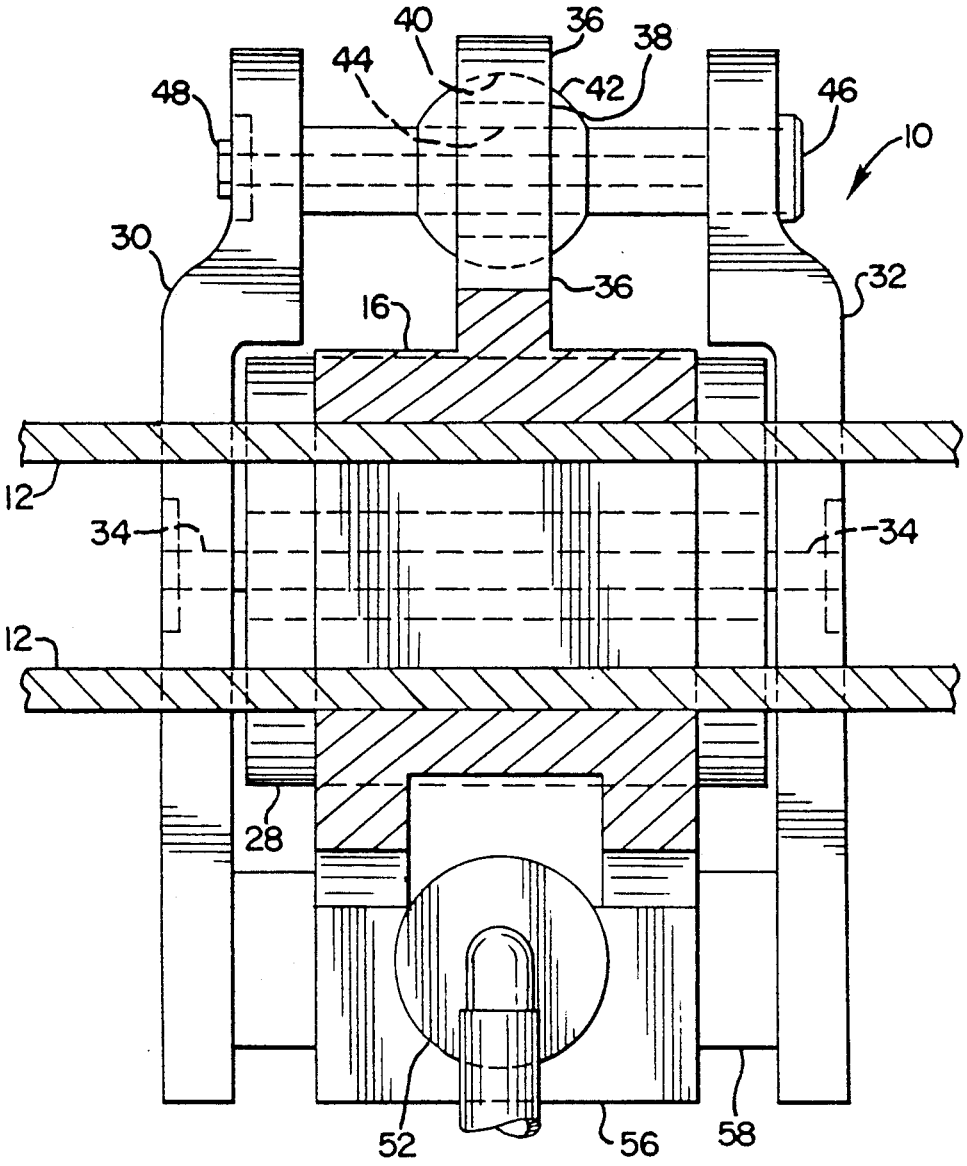
Figure 3:
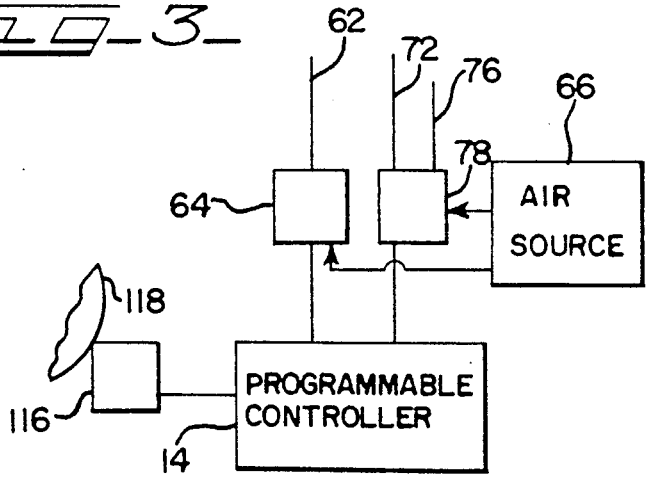

Turning now to the drawings, and particularly FIGS. 1 and 2, the system includes one or more apparatus, indicated generally at 10, each of which is mounted on a mounting bar 12 in a manner whereby the apparatus can be moved along the length of it to position the same as required for the printing job being done. In this regard, there may be several apparatus 10 such as the one apparatus shown in FIGS. 1 and 2, positioned along the width of a web being printed, and the mounting bar is provided to preferably span the entire width of the web being printed. It is contemplated that a single programmable controller 14 (see FIG. 3) will be sufficient to control the operation of a relatively large number of such units. To this end, even if a 38 inch wide web printing press were employed, approximately 19 of such units would be positioned along two mounting bars 12, and a single controller would be able to control all of such units, because they merely control the operation of solenoid valves for moving the ductor wheels into and out of contact with the transfer cylinder in a sequence that is a function of the count of the number of rotations of the impression cylinder, and control the operation of the pumping means, which essentially also only involves similar count sequencing.

The apparatus 10 includes a bracket 16 that has a U-shaped portion 18 that is slightly larger than the cross sectional size of the mounting bar 12 so that it can be moved along the longitudinal direction of the mounting bar 12, and can be locked into the desired position by tightening a knob 20 that has an integral threaded portion 22, the other end of which is recessed into a plate 24 that bears against the mounting bar 12. The threaded portion interacts with threads of an aperture 26, so that when the knob 20 is rotated, it moves vertically to frictional engage the mounting bar 12. When the knob 20 is loosened, the apparatus 10 can be moved along the mounting bar and then be secured by tightening the knob 20.

In accordance with an important aspect of the present invention, the apparatus 10 includes a ductor wheel 28 that is rotatably journaled in a pair of side brackets 30 and 32 by a bolt 34. The ductor wheel 28 may have an outside diameter of approximately three inches and a comparable width. The side brackets are attached to a vertical extension 36 in a ball joint mounting that includes a cylindrical sleeve 38 and an encompassing spherical socket 40 into which a ball 42 of complimentary diameter is fitted for universal movement therein. The ball 42 has an aperture 44 through which a bolt 46 passes, with the bolt is secured by a nut 48. Alternatively, the bolt 46 may engage a threaded aperture in the side bracket 30. The ball joint permits the ductor wheel to contact a transfer cylinder 50 with uniform pressure when the ductor wheel 28 is moved into contact with the cylinder 50.

To move the ductor wheel 28 into and out of contact with the transfer cylinder 50, an air actuated cylinder 52 having a moveable piston 54 is provided, with the cylinder 52 being connected to a lower extension 56 of the bracket 16. The moveable piston 54 is connected to a ball 55 that is connected to a cross member 58 that is attached to the lower portion of each of the side brackets 30 and 32, so that when the cylinder is actuated to extend the piston, the ductor wheel 28 is urged into contact with the transfer cylinder 50, and when the piston is retracted, the ductor wheel 28 is moved out of contact therewith. The ball 55 is loosely held captive in a slot within the cross member so that the ductor wheel is free to move about an axis that extends from the upper ball 42 to the lower ball 55, and thereby assure uniform contact by the ductor wheel 28 and the transfer cylinder 50. The cylinder 52 has a fitting 60 to which an air line 62 is attached, with the air line being connected to a solenoid valve 64 that is controlled by the programmable controller 14, and is also connected to a source of fluid pressure 66, which is preferably a source of positive air pressure, although liquid and other gaseous fluids may be used.

In accordance with another important aspect of the present invention, the ink is supplied to the ductor wheel 28 by means of an ink pumping means 68 which is driven by air pressure supplied by the source 66. The pumping means 68 has an internal moveable piston that is moved downwardly when positive air pressure is applied to a port 70 via line 72, and is moved up when positive air pressure is applied to a port 74 through a line 76. The pumping means 68 is preferably an air operated ejector, Model 83664, series B, as manufactured by the Lincoln Company, One Lincoln Way, St. Louis, Mo. 63120, although other pumping means may be used. A particular advantage of this pumping means is that in the event of a failure, the failure does not result in a flooding of ink in the press, which is a problem of conventional gravity fed metering systems of the prior art. Both lines 72 and 76 are connected to a solenoid valve 78 that is controlled by the controller 14 and the solenoid valve is connected to the source of air pressure 66. Ink is supplied to the pumping means 68 by a flexible conduit or tubing 80 that is conventionally connected to a port 82 in the pumping means 68 from a manifold 84 that preferably extends across the width of the web and is adapted to supply ink to as many apparatus 10 as are provided. The manifold is supplied with ink from a flexible conduit 86 connected to a pump 88 that is located on a supply of ink 90, which may be a 5 gallon pail, a 55 gallon drum, or a larger supply.

The pumping means 68 has its piston adapted to move through its stroke and force a metered amount of ink from an ink outlet port 92 into a flexible tubing 94 which extends to a fitting 96 connected to a reservoir indicated generally at 98, immediately adjacent the ductor wheel. The reservoir 98 comprises a preferably metal arcuate member 100 having side lips 102, which member 100 extends as shown from an approximate "3 o'clock" position to a "7 o'clock" position, when in the position shown in FIG. 1. The side lips 102 are slightly outside, but generally coextensive with the outer edges of the ductor wheel so that the ductor wheel does not contact the side lips. A thin layer, preferably of felt, but which can be some other absorbent material, and preferably approximately ⅛th inch in thickness, is located inside of the member 100 in close proximity to the surface of the ductor wheel 28, in position to present ink to the ductor wheel when it rotates. In this regard, the felt will expand slightly when it is charged with ink and the ink will migrate to the surface of the felt where it contacts the rubber surface of the ductor wheel 28. The felt layer should fit within the arcuate member 100 such that the felt layer spans the entire width of the ductor wheel. The initial thickness of the felt is not critical and may be slightly thicker than the preferred ⅛th inch. However, when the ductor wheel contacts the felt during rotation, it will wear off whatever felt is in contact with the rubber surface, and will quickly reach the appropriate close clearance as is desired. It is also preferred that the felt extend around the left end of the member 100 (upstream relative to the direction of rotation of the ductor wheel as indicated by the arrow in FIG. 1) and be attached to the outside of the member 100 as shown at 104.

The pumping means 68 has an integral mounting bracket 106 that is modified to have a right angled portion 108, with suitable apertures adapted to receive mounting bolts 110 that secure the pumping means 68 to a plate 112 that is bolted to the bracket 16 by screws 114.

During operation, the amount of ink that is pumped by the pumping means is a function of many conditions, including the type of ink, the speed of operation of the printing press, the surface area of the text and/or graphics that is being printed per revolution of the transfer cylinder. Reinking is also a function of the duration of the time in which the ductor wheel 28 is maintained in contact with the transfer cylinder 50, commonly referred to as the dwell time, which in turn is a function of the speed of the press.

While the amount of ink to be pumped can vary substantially depending upon the above named considerations, it is not uncommon for the pumping means to pump a single drop of ink into the felt every 15 minutes, and the ductor wheel to be moved into contact with the transfer cylinder for a period sufficient to contact the cylinder during only a few revolutions, with this occurring perhaps once per minute.

To control the pumping means 68 and the cylinder 52, the programmable controller 14 is provided. In the illustrated embodiment, it is an Atcom 64, as manufactured by the Automatic Timing Controls Company of King of Prussia, Penna., but another suitable microprocessor based controller may be provided, the functionality of the controller being relatively simple in that it primarily controls solenoid valves in specified sequences as a function of counters that are clocked by some cylinder or component that is proportional to the operating speed of the press. The Atcom 64 is capable of controlling up to fourteen of the apparatus 10.

The controller is connected to a proximity sensor 116 that is adapted to monitor the speed of the press in a conventional manner. This can be located in proximity to one of the primary cylinders 118 (diagrammatically shown in FIG. 3) of the printing press so that there is a known relationship of the speed of the press and the revolutions made by the transfer cylinder 50. The operator in setting up the unit on which the system of the present invention is being used can set the frequency, in terms of the number of press revolutions, of operation of the pumping means 68. The pumping means 68 also has an internal adjustment that permits variation in the quantity of ink that is pumped during each stroke of its internal piston, but in the preferred Lincoln pumping unit, the amount of variation can be generally characterized as changing the volume of a single drop.

The operator can also set the duration of the period in which the ductor wheel 28 is maintained in contact with the transfer cylinder 50, in terms of press revolutions, as well as the period between successive contacts, also in terms of press revolutions. As previously mentioned, this may equate to moving the ductor wheel into contact with the transfer cylinder for only a few revolutions every minute. The controller also has a timing override capability in that if the press stops while a ductor wheel is in contact with the transfer cylinder, the timer will cause the controller to drop out the cylinder 52 to move the ductor out of contact with the transfer cylinder. It is also preferred that the controller have a separate "flood" pushbutton or switch, which when actuated, results in the pumping means 68 operating for one stroke to deliver a drop of ink to the reservoir 98 immediately. This is a manual override that does not interfere with the normal timing sequences, and is provided if it is noticed that more ink is needed, or during start-up.

While the specific commands are not included herein, for they are straight forward and carry out the operations previously described. Broadly stated, the proximity sensors detect press revolutions and update internal counters. The controller monitors the count in such counters, so that when a predetermined count is reached, the controller provides a signal to the appropriate solenoids 64 and 78 to cause the pumping means 68 and cylinder 52 to operate for the appropriate time. In this regard the cylinder 52 is actuated for a period determined by the number of press revolutions, both in terms of the time it maintains the ductor wheel 28 in contact with the transfer cylinder 50 and the time it is out of contact. The pumping means 68 is actuated at time intervals that correspond to the press speed, but the amount of time that air is admitted to cause its internal piston to move is for a short period of time, for example, 0.8 seconds, that is independent of press speed.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A system for providing ink from an external source of ink to a printing unit of the type which has a printing cylinder adapted to print on at least a portion of the width of a web that is carried through the unit, the unit also being of the type which has at least one transfer cylinder for transferring ink to the printing cylinder, the system comprising:

an ink applying means having a rotatable cylindrically shaped ductor wheel and bracket means including a main bracket means having a side bracket means attached thereto, said ductor wheel being carried by said side bracket means, said side bracket means being pivotable relative to said main bracket means, said side bracket means being selectively moveable to move said doctor wheel into and out of contact with the transfer cylinder, said ink applying means having a reservoir located in close proximity to the ductor wheel and adapted to receive ink and apply the same to the outer surface of the ductor wheel;

means for selectively moving said ductor wheel into and out of contact with the transfer cylinder in response to signals received thereby;

means for positively pumping a metered amount of ink to said reservoir of said ductor wheel in response to signals received thereby;

means for sensing the operating speed of the printing unit and for providing signals that are indicative of the operating speed; and, controller means operatively connected to said moving means, said pumping means and to said press speed sensing means, said controller means being adapted to receive said signals from said press speed sensing means and to provide signals to said moving means to selectively move said ductor wheel into and out of contact with said transfer cylinder and to said pumping means to pump ink to said reservoir in accordance with preselected sequences that are a function of said press speed sensing means and time.

2. A system as defined in claim 1 wherein said ductor wheel has a rubber covering around the outer periphery thereof adapted to receive ink for application to the transfer cylinder.

3. A system as defined in claim 1 wherein said reservoir comprises an arcuate member positioned adjacent the ductor wheel and a layer of ink absorbent material located intermediate the outer surface of the ductor wheel and the arcuate member, with the surface of the absorbent material being in close proximity to the surface of the ductor wheel whereby ink pumped into the reservoir will migrate to the surface of the material and be in position to be applied to the surface of the ductor wheel.

4. A system as defined in claim 3 wherein said absorbent material is felt.

5. A system as defined in claim 3 wherein said layer of absorbent material being generally coextensive with said arcuate member and extending beyond the upstream end of the member and attached to the outside of the member.

6. A system as defined in claim 5 wherein said arcuate member has side lips on opposite sides thereof adapted to retain the sides of said absorbent material, said side lips being generally coextensive with the outer edges of said ductor wheel.

7. A system as defined in claim 3 wherein said arcuate member extends through a radial arc that is at least approximately one quarter of the circumference of the ductor wheel.

8. A system as defined in claim 1 wherein said moving means comprises a solenoid valve connected to an external source of positive fluid pressure and a fluid driven cylinder with a selectively extendable and retractable piston, said piston being connected to said side bracket means, said cylinder being connected to said main bracket means, so that extension of said piston moves said ductor wheel toward contact of the ductor wheel and the transfer cylinder.

9. A system as defined in claim 8 wherein said fluid driven cylinder is an air driven cylinder and said source of positive fluid pressure is a source of positive air pressure.

10. A system as defined in claim 8 wherein said pumping means includes a solenoid valve connected to an external source of positive fluid pressure and a fluid operated cylinder having an ink input port, an ink output port, and at least one actuating port, said cylinder having an internal piston that is moveable through a predetermined stroke to force a metered amount of ink located within a cylindrical chamber to said ink output port when fluid pressure is applied to said actuating port, and a flexible conduit for carrying the ink from said ink output port to said reservoir of said ink applying means.

11. A system as defined in claim 10 wherein said pumping means further includes a supply of ink, a source pump associated with the supply, and conduit means for carrying said ink to said ink input port.

12. A system as defined in claim 10 wherein said system includes an elongated mounting bar connected to the structure of the printing unit and extending substantially across the width of the web, said main bracket means being adapted to be mounted to said mounting bar and be moved along the length thereof so as to selectively position the same along the width of the web.

13. A system as defined in claim 12 wherein said pumping means cylinder and said moving means cylinder are connected to said main bracket means.

14. A system as defined in claim 1 further including a proximity sensing means operably connected to said controller means, said sensing means being located adjacent the printing unit and adapted to sense the speed of operation of the printing unit and generate signals that are indicative of such speed.

15. A system as defined in claim 1 wherein the diameter of said ductor wheel approximates the width thereof.

16. A system as defined in claim 15 wherein said controller means is programmable so that said signals can be varied to change the time duration in which the ductor wheel is in and out of contact with said transfer cylinder.

17. A system as defined in claim 16 wherein said controller means is programmable so that said signals can be varied to change the amount of ink that is pumped by said pumping means.

18. A system for providing ink from an external source of ink to a printing unit of the type which has a printing cylinder adapted to print on at least a portion of the width of a web that is carried through the unit, the unit also being of the type which has at least one transfer cylinder for transferring ink to the printing cylinder, the system comprising:

at least one ink applying means having a rotatable cylindrically shaped ductor wheel and bracket means including a main bracket means having a side bracket means attached thereto, said ductor wheel being carried by said side bracket means, said side bracket means being selectively moveable to move said ductor wheel into and out of contact with the transfer cylinder, said ink applying means having a reservoir located in close proximity to the ductor wheel and adapted to receive ink and apply the same to the outer surface of the ductor wheel;

means for each ink applying means for selectively moving said ductor wheel into and out of contact with the transfer cylinder in response to signals received thereby;

means for each ink applying means for positively pumping a metered amount of ink to said reservoir of said ductor wheel in response to signals received thereby;

means for sensing the operating speed of the printing unit and for providing signals that are indicative of the operating speed; and, controller means operatively connected to each said moving means, each said pumping means and to said press speed sensing means, said controller means being adapted to receive said signals from said press speed sensing means and to provide signals to each said moving means to selectively move said associated ductor wheel into and out of contact with said transfer cylinder and to said associated pumping means to pump ink to said associated reservoir in accordance with preselected sequences that are a function of said press speed sensing means and time.

19. A system as defined in claim 16 wherein said system includes an elongated mounting bar connected to the structure of the printing unit and extending substantially across the width of the web, said main bracket means being adapted to be mounted to said mounting bar and be moved along the length thereof so as to selectively position the same along the width of the web.

20. A system as defined in claim 17 including a plurality of said ink applying means positioned along said mounting bar for applying ink to respective portions of the web of the printing unit.

21. A system as defined in claim 20 wherein said controller means is programmable so that said signals can be varied to change the time duration in which the ductor wheel is in and out of contact with said transfer cylinder.

22. A system as defined in claim 21 wherein said controller means is programmable so that said signals can be varied to change the amount of ink that is pumped by said pumping means.

* * * * *